United States Patent [19]

Tremblay

[11] Patent Number: 4,754,516

[45] Date of Patent: Jul. 5, 1988

[54] BRUSH HAVING REMOVABLE HANDLE

[75] Inventor: Jean H. Tremblay, Trois-Rivières Ouest, Canada

[73] Assignee: Pinceaux Universels Clic Ltd., Trois-Rivières, Canada

[21] Appl. No.: 3,330

[22] Filed: Jan. 14, 1987

[30] Foreign Application Priority Data

Nov. 28, 1986 [CA] Canada ..... 524135

[51] Int. Cl.[4] ..... A46B 3/16; A46B 9/08

[52] U.S. Cl. ..... 15/176; 15/145

[58] Field of Search ..... 15/176, 143 R, 144 R, 15/145, 146, 172, 194, 195, 201, 202; 248/110; 70/38 A, 233

[56] References Cited

U.S. PATENT DOCUMENTS

| | | | |
|---|---|---|---|
| 930,375 | 1/1909 | Hascy . | |
| 1,690,938 | 11/1928 | Maxwell | 70/38 A X |
| 2,514,496 | 7/1950 | Jones et al. . | |
| 2,526,756 | 10/1950 | Krebs . | |
| 2,532,780 | 12/1950 | Pettengill . | |
| 2,677,841 | 5/1954 | Tetzlaff . | |
| 2,712,145 | 7/1955 | Karnes . | |
| 2,763,884 | 9/1956 | Fritz . | |
| 2,854,684 | 10/1958 | Hardman et al. | 15/193 |
| 2,900,654 | 8/1959 | Koltvedt . | |
| 3,231,919 | 2/1966 | MacDonald | 15/DIG. 4 X |
| 3,340,557 | 9/1967 | Rosenzweig . | |
| 3,783,468 | 1/1974 | Saloutos . | |
| 4,020,520 | 5/1977 | Dellas . | |
| 4,469,223 | 9/1984 | Smith . | |
| 4,683,604 | 8/1987 | Rueb | 15/176 |

FOREIGN PATENT DOCUMENTS

| | | | |
|---|---|---|---|
| 947916 | 5/1974 | Canada . | |
| 289029 | 6/1953 | Switzerland | 15/145 |
| 1328461 | 8/1973 | United Kingdom | 15/176 |

*Primary Examiner*—Peter Feldman

*Attorney, Agent, or Firm*—Robic, Robic & Associates

[57] ABSTRACT

A brush includes a movable handle in the form of nippers and a head having a housing at least on one side, sized for receiving the handle. The latter is made up of two rods of equal length joined together at one of their ends and secured to the head by a set of notches and detents provided in the housing and the free ends of the handle. Securing of the handle to the head is obtained by latching of the detents in the notches. Such a brush is particularly advantageous inasmuch as it makes it extremely simple to replace the head by another one having identical or different size or shape.

16 Claims, 4 Drawing Sheets

BRUSH HAVING REMOVABLE HANDLE

BACKGROUND OF THE INVENTION

1. Field of the Invention

The present invention relates to a brush of which the handle is movable and has the form of a nipper.

2. The Prior Art

There presently exists a large number of brushes having a removable handle and/or an interchangeable head for hair-mount. Such brushes make it possible to replace the hair-mount at will either for adapting a hair-mount of desired width or for replacing a worn out hair-mount. Reference is made, in this respect, to the following U.S. patents:

| |
|---|
| 2,712,145 |
| 2,763,884 |
| 2,900,654 |
| 3,783,468 |
| 4,469,223 |
| 2,677,841 |
| 2,526,756 |
| 2,514,946 |
| 3,340,557 |

If all of the brushes disclosed in the above patents have certain advantages, they all have in common the disadvantage of using means that are neither simple or are of doubtful efficiency when it comes to securing the handle to the head. Thus, certain securing means call for locking systems, others fail to provide a connection which is sufficiently solid between the head and the handle.

Another example relating to means of securing the hair-mount and the handle to the head is disclosed in Canadian Pat. No. 947,916. According to this patent, the hair-mounts are inserted and held in the support of the brush head by a set of cavities provided in the head support and in which the supports are lodged, having a shape corresponding to the hair-mounts. The insertion and the latching of the hair-mount supports in the cavities is obtained by forcefitting the hair-mounts in the cavities. According to this embodiment, the head of the brush is likewise joined to a conventional handle by a sole system of cavities and protuberances. Indeed, the part of the head support which comes to be inserted in the handle is provided with a cylindrical projection from which two cylindrical ribs project and securing of the head to the handle is obtained by latching of the head in a corresponding cavity provided inside the handle. However, in order to provide for completing the brush, it is necessary to hold the head in one hand and the handle in the other which may reveal itself to be uncomfortable when the brushes have already been used. On the other hand, connecting the handle and the head necessitates the use of an appreciable force. Likewise, the operation of dismantling the brush involves similar disadvantages since it is necessary to forcibly pull in order to release the head.

PURPOSE OF THE INVENTION

The object of the present invention is to provide a brush which, due to its structure which is both simple and efficient, avoids the disadvantages mentioned above. As in all brushes having a removable handle, the brush according to the invention has the advantage to be economical since it makes it possible to replace its head by others having a shape and dimensions that are either identical or different besides and due to its particular structural features, makes it likewise possible to easily obtain mounting and dismounting of the handle when changing heads. Indeed, these operations are made easy by the particular structure of its handle which is in the form of nippers which, due to its elasticity, may be inserted and driven inside the head by simply pushing on it until interlocking is obtained. Interlocking requires only a handle cooperating with a head without it being necessary to call for additional means to ensure a firm connection of the assembly. Thus, mounting of the handle becomes an operation which is simple and efficient.

Inversely and always because of the elasticity of the handle in the form of nippers, removal of the handle is carried out by a mere lateral pressure on the rods of the handle, thereby allowing rapid freeing of the head.

Furthermore, the handle is provided with non-skid grooves which, along with the nippers, conjointly make it possible to obtain a firm grip thereby facilitating the use of the brush.

SUMMARY OF THE INVENTION

According to the invention, there is provided a brush comprising: a handle; a head including a hair-mount at one end and including also means defining an open-top housing, further means being also included for removably securing the handle to the head. The brush of the invention is essentially characterized in that its handle has the form of nippers made of a pair of rods of equal length solidly joined at one of their ends and having their other ends free so that the rods may move flexibly laterally at the said other ends. The handle and the head are secured together by detent and notch latch or interlocking means provided in the housing and on the free ends. With the structure according to the invention, the handle is removably secured to the head by insertion of the rod free ends into the housing through its open top until, by lateral displacement of the rod free ends, the detent and notch means cooperatively latch or interlock to hold the handle and the head together.

According to a preferred embodiment, the housing defining means comprise two opposed lateral walls; the detent and notch means on the other hand, being detents and notches symmetrically provided on the lateral walls and on facing surfaces of the free ends of the nipper rods, interlocking or latching of the detents and notches being caused by successive lateral displacement of the rod free ends toward and away from one another during insertion of the handle into the housing. The detents may preferably be provided on the lateral walls while the notches could be provided at the free ends of the rod. Again, the detents may each be in the form of a right angle triangle of which the hypothenuse extends downwardly away from the open top of the housing and from one of the lateral walls.

Other features and advantages of the present invention will appear from the description as follows of the preferred embodiment, having reference to the appended drawing.

DESCRIPTION OF THE PREFERRED EMBODIMENT

Figure 1:
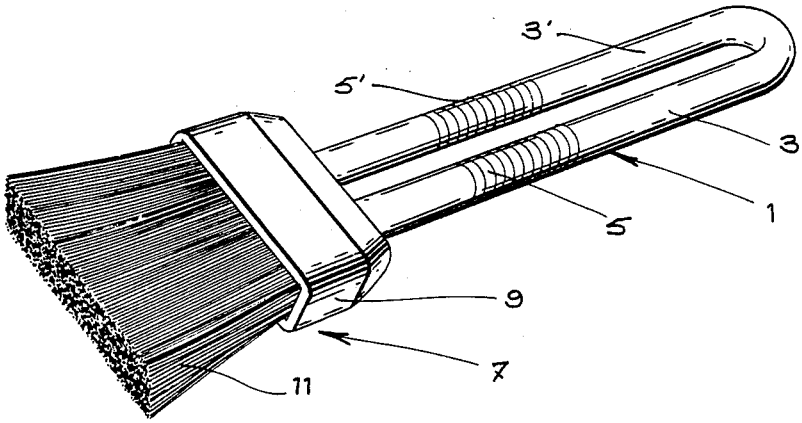
FIG. 1 is a perspective view of a brush made according to the invention with the handle inserted in use position.

The brush shown in FIG. 1 comprises a handle 1 shaped like nippers comprising two rods 3 and 3' of equal length and joined together solidly at one of their ends. This handle is provided with handling means 5 and 5' constituted by small non-skid grooves located in the lower half of the corresponding rods 3, 3'. Such handling means are made to provide a firm grip of the handle which thus facilitates the use of the brush.

The latter also comprises a head 7 which includes a hair-mount 9 and a brush proper made up of the hair 11 fixed on the hair-mount 9.

Figure 2:
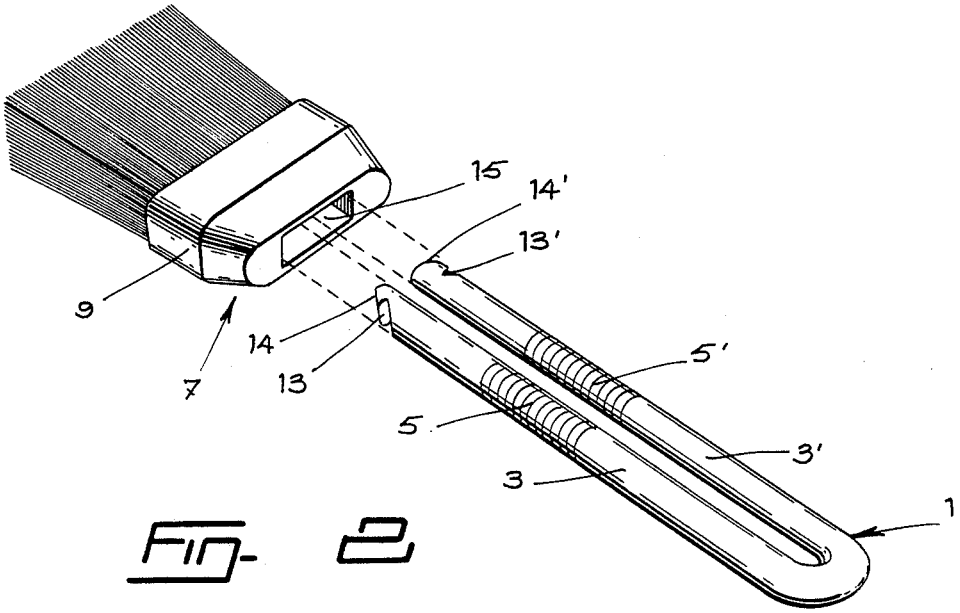
FIG. 2 is a perspective view of the brush of FIG. 1 with the handle removed.
Figure 3:
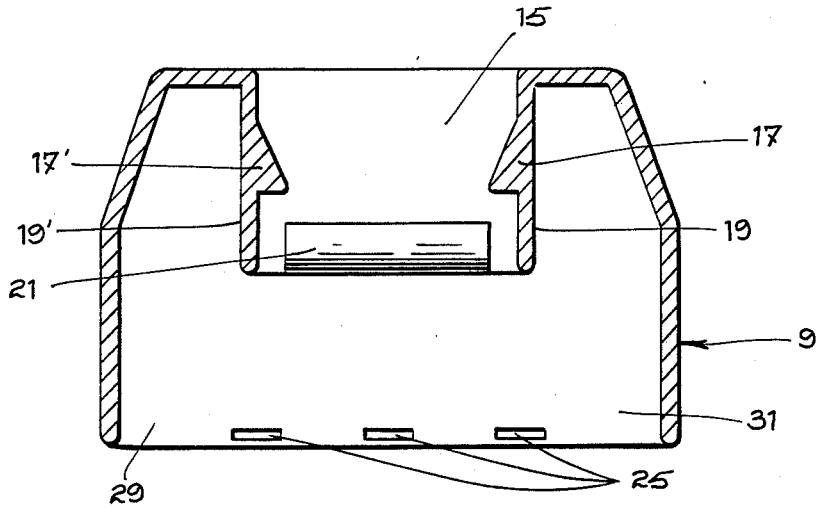
FIG. 3 is a longitudinal cross-sectional view through the brush head of FIG. 1.

FIGS. 2 and 3 illustrate the manner in which the handle of the brush is fixed to the head 7.

As shown in FIG. 2, the two handle rods 3, 3', are formed with lateral outwardly open notches 13, 13', formed in the lower part of each corresponding rod. The free extremities of the rods 3, 3', are outwardly bevelled as at 14 and 14' so as to facilitate their insertion and their removal from the head 7. On the other hand, the head 7 has a rectangular housing 15 defined inwardly of the hair-mount 9, the housing 15 being sized to receive the handle 1. As illustrated in FIG. 3, the housing 15 of the hair-mount 9 comprises two detents 17, 17', symmetrically provided on two opposed narrow sidewalls 19, 19', of the rectangular housing 15. Each of the detents 17, 17', is in the form of a right angle triangle of which the hypothenuse extends downwardly away from the top open end of the housing 15 and from the relevant narrow sidewalls.

Through such means, the handle 1 is inserted in the housing 15, provided within and at the top of the hair-mount 9, by simply pushing on the handle 1. The flexibility of the nippers-like handle 1 makes this insertion possible without it being necessary to exert any force. The notches 13 of the two rods 3 of the handle 1 thereafter interlock with the detents 17, 17', of the housing 15. This ratching or interlocking action takes place simply by bending the two rods 3, 3', one toward the other. Securing of the handle 1 on the head 7 is thus obtained and the result is a firm holding of the two together.

Figure 4:
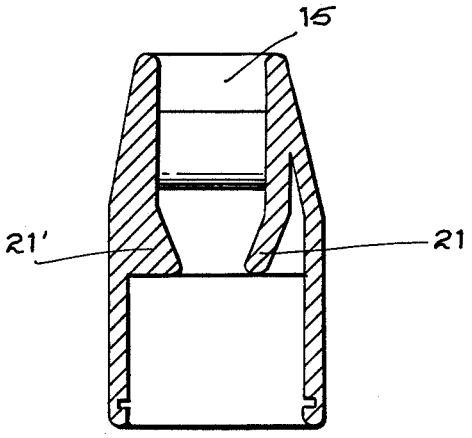
FIG. 4 is a cross-sectional view at right angle to that of FIG. 3.

FIGS. 3 and 4 illustrate means for limiting the penetration of the rods 3 during their insertion in the housing 15. Such means are constituted by two tongues 21, 21', projecting from the opposed larger sidewalls of the rectangular housing 15, being directed toward the bottom of the same housing 15. The tongue 21' is rigid. The other tongue 21 is, on the other hand, supple so as to provide a certain elasticity. In use, when the two rods, 3', 3'', of the handle 1 are inserted into the housing 15, their lower ends come in contact with the two tongues which then limit the penetration of the handle 1 in the head 7. Such means make it possible to improve the firmness of the connection between the handle 1 and the head 7. Similarly, the resiliency of the tongue 21 makes it possible to release the rods 3 of the handle 1 from the detents 17, 17', easily, during removal of the handle by forcing the latter down slightly against the resilient tongue 21 at which time the lower ends of the rods 3, 3', way more easily be brought toward one another to avoid the detent 17, 17'.

Figure 5:
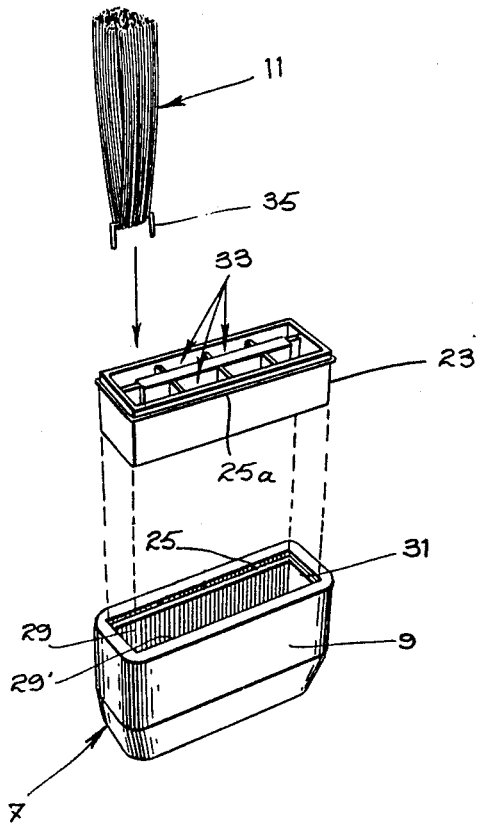
FIG. 5 is an exploded view, in perspective, of the head of the brush of FIG. 1.

FIGS. 3 and 5 illustrate means for mounting the hair 11 on the mount 9 of the head 7.

Such means comprise a small socket 23 comprising a plurality of cavities 33 each intended to receive a tuft of hair 11. The socket 23 is secured to the internal walls of the hair-mount 9 by means of a peripherical projection 25*a* extending all around the side walls of the socket 23. The projection 25*a* comes to interlock in the corresponding peripherical groove 25 provided in the surface of the internal walls a second housing 31 provided in hair-mount 9 opposite the end where the housing 15 is defined. The hair 11 are fixed in each cavity 33 of the socket 23 by means of a staple 35 set directly in the bottom of the socket 33. The staple 35 holds the hair 11 in bent position inside the corresponding cavity, thereby reducing the risk that the hair 11 pull out of the head 7.

Figure 6:
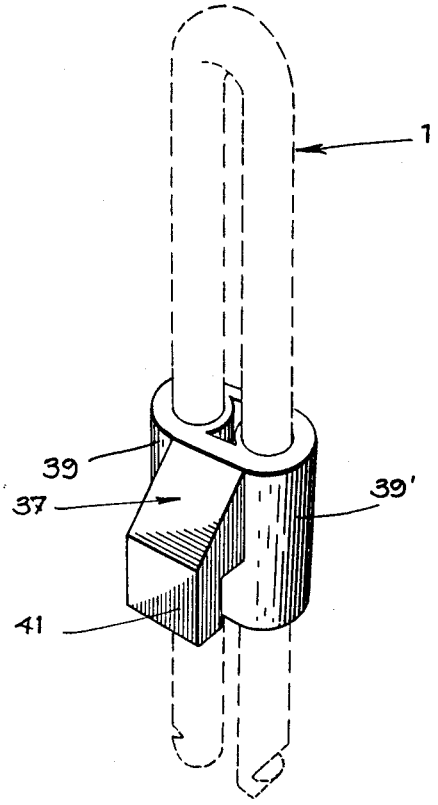
FIG. 6 is a perspective view of a hanging device capable of being mounted on the brush of FIG. 1.

FIG. 6 illustrates a hanging means 37 in the form of a body having two parallel tubes 39, 39', joined together and from which a hook 41 depends. These tubes are sized to receive one or the other of the two rods 3, 3'. By this hanging means, it is easy to put the brush aside when no longer needed.

Figure 7:
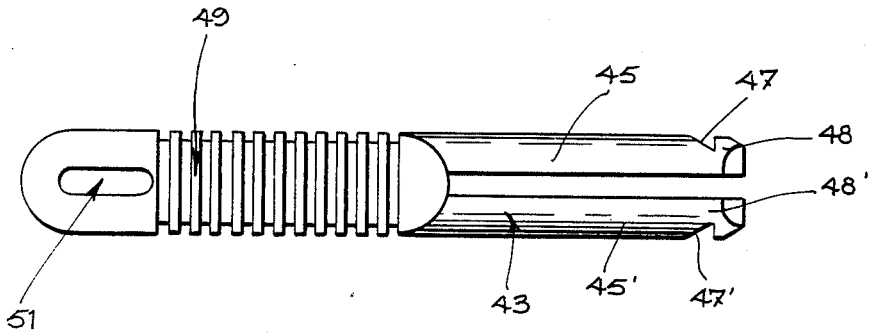
FIG. 7 is a plan view of a variant of the handle of the brush of FIG. 1.

FIG. 7 illustrates another embodiment of a handle made according to the invention, constituted by nippers 43 comprising two parallels 45, 45', provided with two lateral external bevelled notches 47, 47', similar to notches 13, 13', and of which the ends 48, 48', are outwardly and downwardly bevelled like the ends 14, 14', as well as a handle means 49 lengthening the handle along its longitudinal axis. The said handling means comprise a series of non-skid parallel transverse grooves 49 in its upper half and a slot 51 to hang the brush.

While the present invention has been described by means of a preferred embodiment, it is to be noted that any modification of this embodiment or other use of the latter may be made provided it does not lie within the appended claims without changing the nature of the present invention.

Thus, by way of example, one could easily use the same kind of structural arrangement to detachably secure to each other the head and handle of a tool or implement such as a rake, a mop, a broom and the like.

What is claimed is:

1. A brush comprising:

a handle in the form of nippers made of a pair of rods of equal length solidly joined at one of their ends and having their other ends free so that said rods are movable flexibly laterally at said other end;

a head including a hair-mount at one end and means defining an open-top housing at the other end;

means for removably securing said handle to said head, said securing means comprising detent and notch latch means provided in said housing and on said rod free ends whereby removable securement of said handle to said head is achieved by insertion of said rod free ends into said housing through the open top thereof until, by lateral displacement of said rod free ends, said detent and notch means cooperatively latch to hold said handle and said head together; and means in said housing for limiting penetration of said nippers into said housing; wherein said limiting means comprise a pair of tongues in said housing, facing one another, said tongues being inclined toward one another and being spaced from one another at their free ends thereof a distance smaller than the total width of said rod free ends; said tongues being located below and laterally of said latch means and having a length suitable for holding said detent and notches in latching condition when in said housing.

2. A brush as claimed in claim 1, characterized in that said housing-defining means. comprise two opposed lateral walls and said detent and notch means comprise detents and notches symmetrically provided on said lateral walls and on facing surfaces of said free ends of said nipper rods; latching of said detents and notches being caused by successive lateral displacement of said rod free ends toward and aay from one another during insertion thereof into said housing.

3. A brush as claimed in claim 2, characterized in that said detents are provided on said lateral walls and said notches are rovided at said free ends of said rods.

4. A brush as claimed in claim 2, characterized in that said detent and latch means comprise detents, each of which is in the form of a right angle triangle of which the hypothenuse extends downwardly, away from said open top of said housing, from one of said lateral walls.

5. A brush as claimed in claim 4, characterized in that said rod free ends are outwardly and downwardly bevelled to ride on said hypothenuse thereby facilitating insertion thereof into said housing.

6. A brush as claimed in claim 2, characterized in that said head is opened at said hair-mount end and characterized in further comprising: a grate, having bar-defining holes therethrough, secured to said hair-mount at the open end thereof, and U-bent hair extending through said holes and around said bars defining said holes.

7. A brush as claimed in claim 1, characterized in that said rods are formed with non-skid grooves.

8. A brush as claimed in claim 1, characterized in that it further comprises: hanging means in the form of two parallel tubes solid with one another and a hook joined to said tubes; said tubes having a diameter suitable for snugly receiving said rods so as to mount said hanging means thereon.

9. A brush as claimed in claim 1, characterized in that it further comprises gripping means extending from said nippers at said joined ends of said rods.

10. A brush as claimed in claim 9, characterized in that said gripping means include non-skid grooves.

11. A brush as claimed in claim 1, characterized in that said head is opened at said hair-mount end and characterized in further copmrising: a grate, having bar-defining holes therethrough, secured to said hair-mount at the open end thereof, and U-bent hair extending through said holes and around said bars defining said holes.

12. A brush as claimed in claim 1, wherein one of said tongues is flexible.

13. An implement comprising a handle; a head including means defining an open-top housing; and means removably securing said handle to said head, characterized in that:

said handle is in the form of nippers made of a pair of rods of equal length solidly joined at one of their ends and having their other ends free so that said rods are movable flexibly laterally at said other end;

said securing means comprise detent and notch latch means provided in said housing and on said rod free ends whereby removable securement of said handle to said head is achieved by insertion of said rod free ends into said housing through the open top thereof until, by lateral displacement of said rod free ends, said detent and notch means cooperatively latch to hold said handle and said head together, and means are provided in said housing for limiting penetration of said nipper in said housing, said limiting means comprising a pair of tongues in said housing, said limiting means comprising a pair of tongues in said housing, facing one another, said tongues being inclined toward one another and being spaced from one another at their free ends thereof a distance smaller than the total width of said rod free ends; said tongues being located below and laterally of said latch means, and having a length suitable for holding said detent and notches in latching condition when in said housing.

14. An implement as claimed in claim 13, characterized in that said housing-defining means comprise two opposed lateral walls and said detent and notch means comprise detents and notches symmetrically provided on said lateral walls and on facing surfaces of said free ends of said nipper rods; latching of said detents and notches being caused by successive lateral displacement of said rod free ends toward and away from one another during insertion thereof into said housing.

15. An implement as claimed in claim 14, characterized in that said detents are provided on said lateral walls and said notches are provided at said free ends of said rods.

16. An implement as claimed in claim 14, characterized in that said detents and latch means comprise detents, each of which is in the form of a right angle triangle of which the hypothenuse extends downwardly, away from said open top of said housing, from one of said lateral walls.

* * * * *